United States Patent [19]

Pansini et al.

[11] 4,023,581

[45] May 17, 1977

[54] AUTOMATIC SWIMMING POOL CLEANER

[75] Inventors: Andrew L. Pansini, Belvedere; Fritz Haas, Novato, both of Calif.

[73] Assignee: Andrew L. Pansini, Belvedere, Calif.

[22] Filed: Nov. 10, 1975

[21] Appl. No.: 630,206

[52] U.S. Cl. ..... 134/167 R; 15/1.7; 115/11

[51] Int. Cl.² ..... B63H 11/02; B08B 3/02

[58] Field of Search ..... 115/11, 12 R; 134/24, 134/167 R, 168 R, 172; 15/1.7; 4/172.15, 172.16; 239/229

[56] References Cited

UNITED STATES PATENTS

| | | | |
|---|---|---|---|
| 3,032,044 | 5/1962 | Pansini | 134/168 R |
| 3,170,180 | 2/1965 | Winston et al. | 134/167 R |
| 3,392,738 | 7/1968 | Pansini | 134/167 R |
| 3,665,942 | 5/1972 | Moore | 134/167 R |
| 3,921,654 | 11/1975 | Pansini | 134/167 R |
| 3,926,667 | 12/1975 | Gibellina | 134/167 R |

*Primary Examiner*—Trygve M. Blix
*Assistant Examiner*—Jesus D. Sotelo
*Attorney, Agent, or Firm*—Naylor, Neal & Uilkema

[57] ABSTRACT

A swimming pool cleaner is provided with a submergible disc-shaped transporter to which there is rotatably connected a drive jet. A flexible water supply hose provided with its own drive jet is connected to the drive jet for the transporter.

11 Claims, 14 Drawing Figures

AUTOMATIC SWIMMING POOL CLEANER

An object of the invention is to provide a cleaner of the submergible transporter type which is essentially stall-proof.

Another object of the invention is the provision in such a cleaner of control means to prevent the transporter from moving with repetitive circular orbiting and to instead cause it to move straight forwardly from one side of the pool to the other.

Other objects and advantages of the invention will be apparent from the following description taken in conjunction with the drawings forming part of this specification, and in which.

Figure 1:
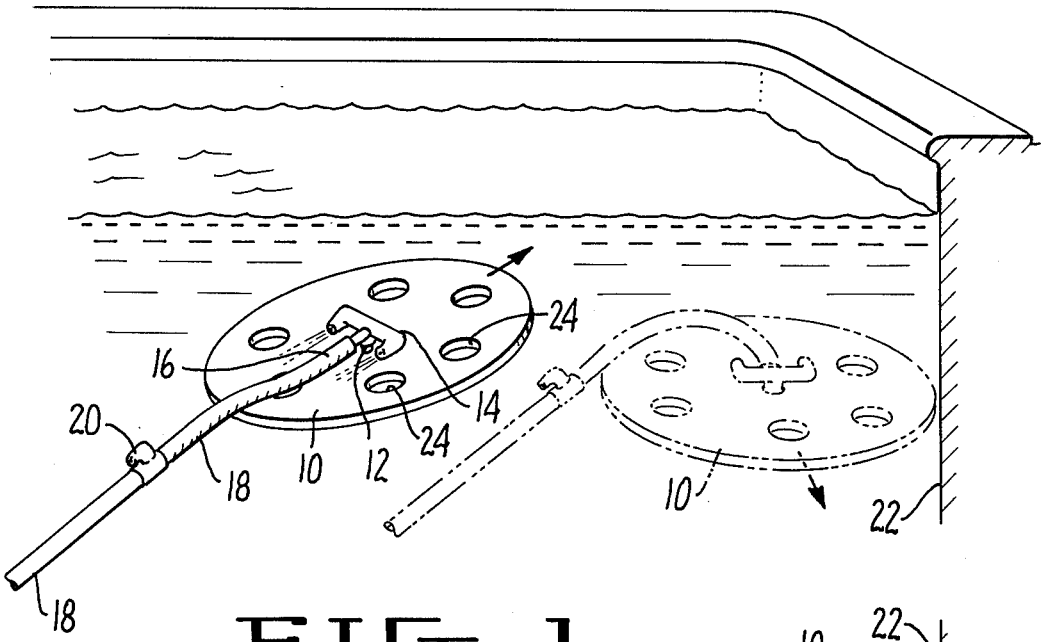
FIG. 1 is a view in perspective of an embodiment of the cleaner of this invention.

The cleaner of FIG. 1 comprises a submergible transporter in the form of a disc 10. The disc has a swivel connection 12 with a twin jet assembly 14 to which the distal end 16 of water supply hose 18 is attached. The supply hose 18 is provided with its own drive jet 20 which is adapted to maintain the upstream portion of the supply hose under tension. That part of the supply hose 18 which is forward of the jet 20 is preferably lighter and more flexible than the main portion of the supply hose which is upstream of the jet 20. The idea is to make sure that the leading portion of the supply hose will readily bend, as shown in dotted outline in FIG. 1, when forward movement of the disc is obstructed. When the movement of the disc is slowed down in this way the action of jet 20 causes the front section of supply hose to bend and thereby turn the jet assembly 14 so that the latter can drive the disc 10 out of its obstructed or impeded condition, as for example when the disc is brought to a halt in a corner of the pool. The supply hose 18 is provided with a plurality of such drive jets 20, each of which imparts a towing force to the section of supply hose adjacent thereto and immediately upstream thereof.

Figure 2:
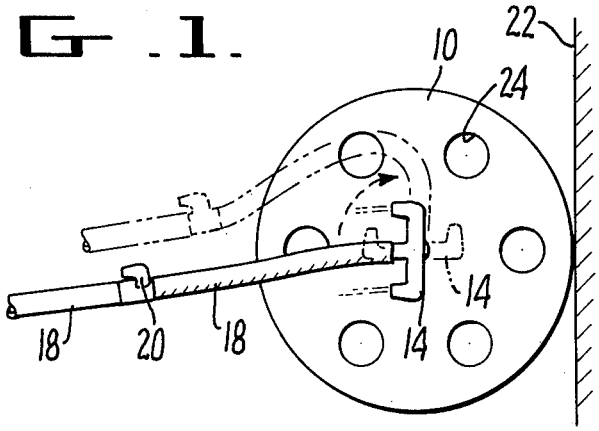
FIG. 2 is a plan view of the cleaner of FIG. 1.

FIG. 2 shows in solid outline the disc 10 coming into engagement with the pool wall 22. This stops the disc against further movement in the same direction but the jet 20 continues to move forwardly in the same direction to cause the forward end of the supply hose to bend, as shown, and thereby cause the jet assembly 14 to be rotated to the dotted line position of FIG. 2 to drive the disc in a new line of direction along the wall 22. The disc turns or rolls along the wall while it engages the wall.

Disc 10 is provided with a plurality of apertures 24 which extend fully through the disc. These apertures free the disc from its attraction for the floor of the pool and in particular the main drain opening which is normally in the floor of the pool in a central area of the deep end. Without the apertures 24 the disc 10 tends to be pressed against the bottom of the pool when it is travelling over the bottom fairly closely thereto, and without the apertures 24 the disc can be trapped and rendered immobile by the main drain opening.

It should be pointed out that all of the embodiments of the cleaner of this invention are free of the pendent wall and floor cleaning hoses which have been a common feature of most previous pool cleaners. Instead, the cleaners of the subject invention utilize the plurality of supply hose drive nozzles 20 to clean the dirt from the pool walls.

The cleaner embodiment of FIGS. 1 and 2 moves for the most part along the bottom of the pool and up and down the side walls thereof. It is also capable of moving through the water in the pool with a planing action out of engagement with the bottom and side walls of the pool.

Figure 3:
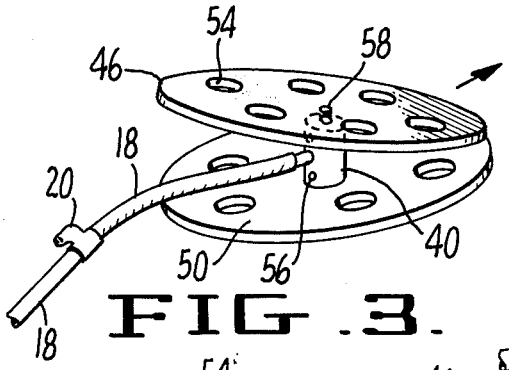
FIG. 3 is a view in perspective of another embodiment of the subject cleaner.
Figure 4:
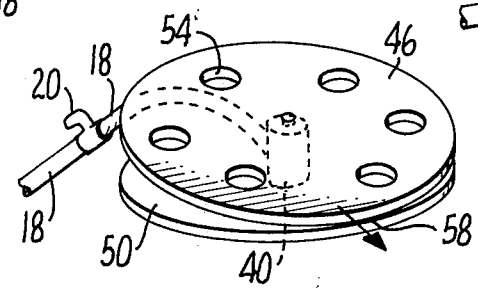
FIG. 4 is another view in perspective of the cleaner of FIG. 3.
Figure 5:
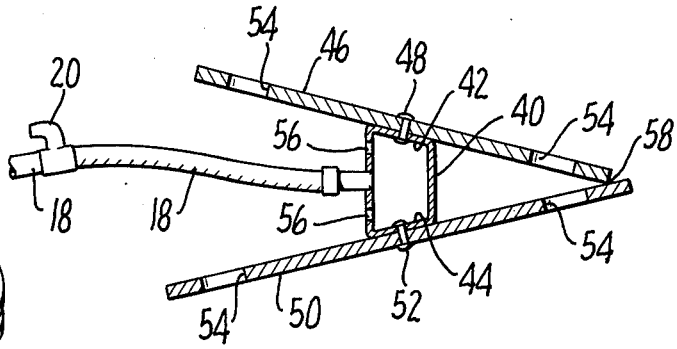
FIG. 5 is an enlarged view in section of the cleaner of FIGS. 3 and 4.

Another embodiment of the present invention is illustrated in FIGS. 3–5. Here the transporter part of the cleaner comprises a hub member 40 having slanted or biased end walls 42 and 44, an upper disc 46 having a pivotal connection 48 with the upper wall 42 of the hub, and a lower disc 50 having a pivotal connection 52 with the lower wall 44 of the hub. Both discs are provided with apertures 54 for the purpose described previously in connection with FIGS. 1 and 2. The supply hose 18 is connected to the hub 40. A vertically spaced pair of drive jet openings 56 is provided in the hub in alignment with the line of attachment of the supply hose to the hub. The supply hose is provided, as in the previous embodiment, with a plurality of drive jets such as jet 20. The supply hose 18, and in any case the portion thereof which is ahead of the first jet 20, is readily flexible or bendable so that when the discs are impeded the action of the jet or jets 20 bends the leading part of the hose to turn the hub and reorient the direction of the jets 56 so that the latter may drive the discs out of their condition of obstruction.

It is to be appreciated that a turning movement of the hub 40 relative to the discs 46 and 50 causes the point of closest approach between the peripheries of the two discs to shift. This point of closest approach, indicated by reference numeral 58 in the drawing is always located at 180° to the line of direction of the jet openings 56, i.e. the point 58 is always located at the front of the two discs with reference to their line of movement at any particular moment.

Figure 6:
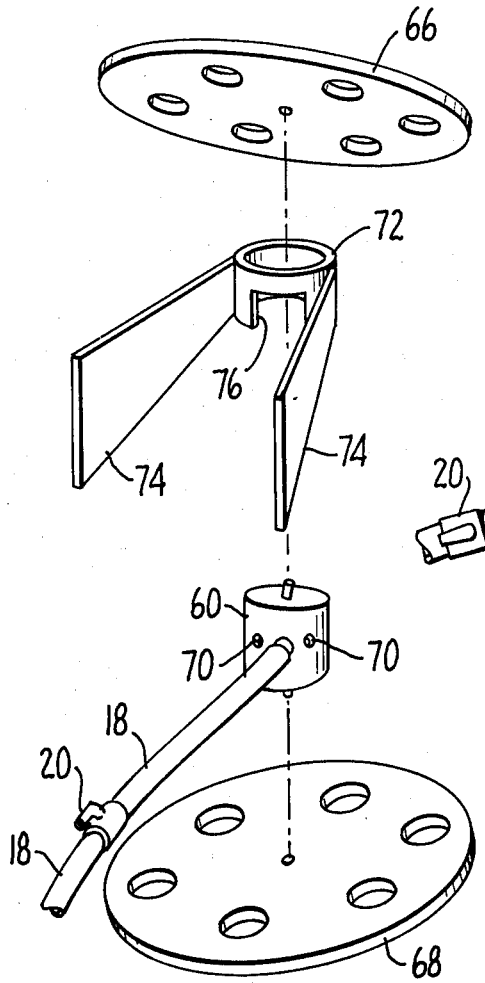
FIG. 6 is an exploded view in perspective of a further embodiment of the subject invention.
Figure 7:
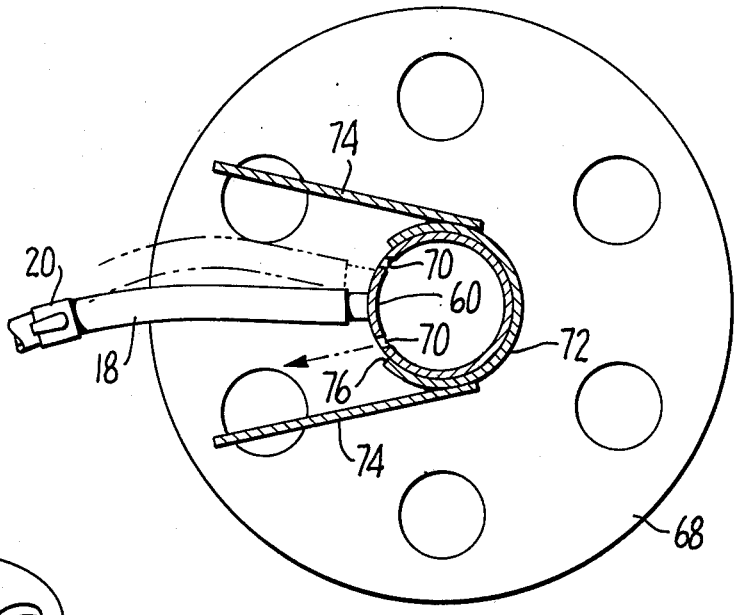
FIG. 7 is a view partly in plan and partly in section of the assembled cleaner of FIG. 6.
Figure 8:
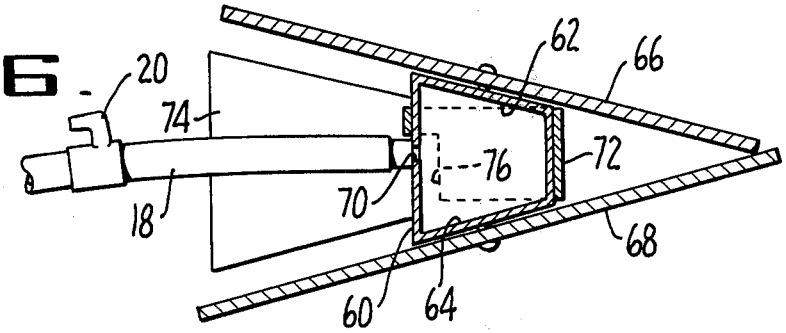
FIG. 8 is another view in section of the cleaner of FIGS. 6 and 7.

A further embodiment of the invention is shown in FIG. 6–8. This embodiment is quite similar to the embodiment of FIGS. 3–5. It comprises a hub member 60 having slanted or biased upper and lower walls 62 and 64, upper disc 66 and lower disc 68. The supply hose 18 is provided with a plurality of drive jets 20 and connects to the hub between a pair of horizontally spaced jet openings 70 formed in the hub. Sleeved on the hub for ready turning movement relative thereto is a collar 72 to which is attached a pair of rearwardly extending and somewhat diverging wing or rudder elements 74. Formed in the collar centrally between the wing elements 74 is a slot 76 through which the jet openings 70 are normally directed, as shown in FIG. 7.

The purpose and function of the wing and collar assembly may be best understood by considering the movement tendencies of the cleaner in the absence of this assembly. Once the leading part of the supply hose 18 bends under the action of the one or more jets 20, as previously described, there is a tendency for the disc assembly or transporter to travel with a spiralling pattern of fairly tight circular orbits. This is a type of movement which has its place in the field of automatic pool cleaners. However, the wing and collar assembly prevents that type of movement in favor of causing the disc assembly to travel across a pool along a straight line resultant. The wing and collar assembly orients itself under the influence of the water pressure forces so that it is positioned symmetrically with respect to the line of movement of the disc assembly at any given moment. Considering FIG. 7 and that the leading portion of the supply hose is bending upwardly as shown in dotted outline in FIG. 7, further such bending movement of the hose in the same direction would hide the upper jet 70 behind the collar 72, thereby in effect turning off the hidden jet. The lower jet (FIG. 7) which remains operative causes counterclockwise rotation of the hub 60 relative to the collar 72 to bring the upper jet 70 out from behind the collar 72. Thus, a tendency of the disc assembly to follow a curving path is accompanied by a hiding of one of the jets, and this is followed by the resulting action of the remaining jet to drive the hub in a direction to bring the hidden jet out into the open once more, the overall result being that the resultant course of movement of the disc assembly would be in a straight line across the pool, with side to side corrective veerings en route. This is the action that is produced by the wing and collar assembly while the disc assembly is normally moving through the water.

When the disc assembly is obstructed, as by the disc assembly being driven directly against a side wall of the pool, the forward movement of the disc assembly is reduced to zero and the resistance of the collar and wing assembly to turning movement is also essentially reduced to zero. Thus, as the leading part of the supply hose bends to redirect the jets the force of the jets will tend to keep the wings 74 symmetrically located with respect to the two jet openings 70, i.e. the collar and wing assembly will likewise turn to keep the two jets open and permit the turning movement of the disc assembly and the resulting driving free of the disc assembly from the obstruction of the side wall.

The supply hose connector tube which is carried by the hub is trapped within the collar slot 76 to limit rotative movement of the hub in relation to the collar and thereby keep at least one of jet openings 70 open.

Figure 9:
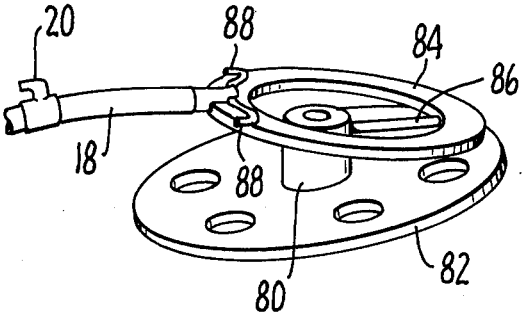
FIG. 9 is a view in perspective of still a further embodiment of the invention.
Figure 10:
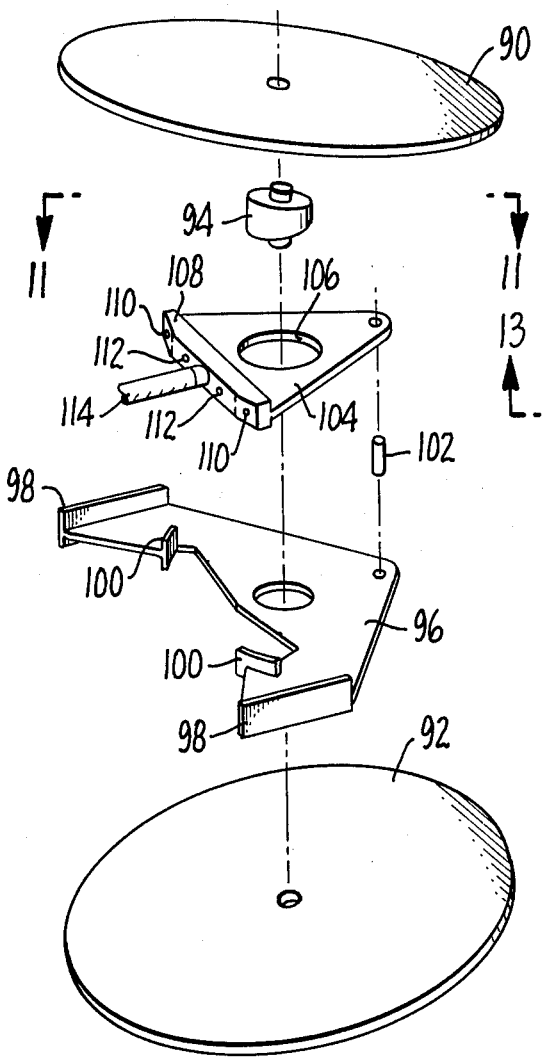
FIG. 10 is an exploded view in perspective of the preferred embodiment of the invention.

Still a further embodiment of the invention is shown in FIG. 9. The transporter comprises hub 80, a lower disc 82 connected to the hub for rotational movement relative to the latter, and an annular ring 84 which is fixedly attached to the hub 80 by web member 86. The supply hose 18 which is provided with a plurality of jets such as 20 communicates with a pair of drive jets 88. The ring 84 is tilted so that it almost touches the disc 82 at a point which is in alignment with the web member 86 and the line of connection of the hose 18 to the ring. The ring thus serves the purpose in several respects of the upper disc of the above-described embodiments. Additionally it serves as a means for driving the transporter through a pulling force rather than a pushing force whereby when the leading portion of the hose 18 bends or tends to bend the tendency of the transporter to fall into a spiralling pattern of circular orbiting is minimized due to the fact that the driving force on the transporter is applied thereto by a pull rather than a push. The jets 88 push the ring 84 but the latter through the rigid interconnecting web member 86 pulls the hub 80 and thereby the entire transporter.

The preferred embodiment of the invention is shown in FIGS. 10–14. It comprises upper and lower discs 90 and 92 rotatably connected to hub 94. A gull-wing blade member 96 having twin rudder elements 98 is sleeved on the hub and provided with jet-blocking tabs 100. Pivotally connected to member 96 by pin 102 is drive plate 104 having an oversize clearance aperture 106 for the hub which enables the plate 104 to swing to either side of the hub. Plate 104 is provided with a manifold 108 having outer jet openings 110 and inner jet openings 112, and the manifold is connected to supply hose 18 by connector tube 114. The supply hose 18 is provided with one or more drive jets 20.

Figure 11:
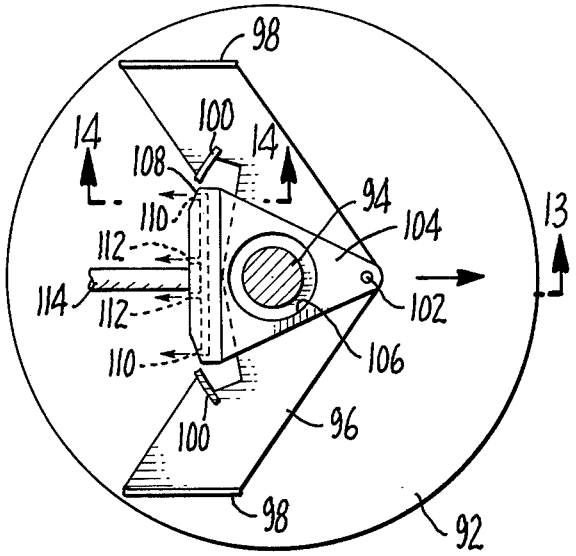
FIG. 11 is a view of FIG. 10 cleaner in assembled condition, as though taken along lines 11—11 of FIG. 10.

FIG. 11 shows the cleaner in straight ahead operation, the parts being symmetrically disposed and all four jets 110, 112 being unblocked and operating. The drive plate is pushing the pin and the latter is pulling the gull-wing member 96 which in turn is pulling the hub.

Figure 12:
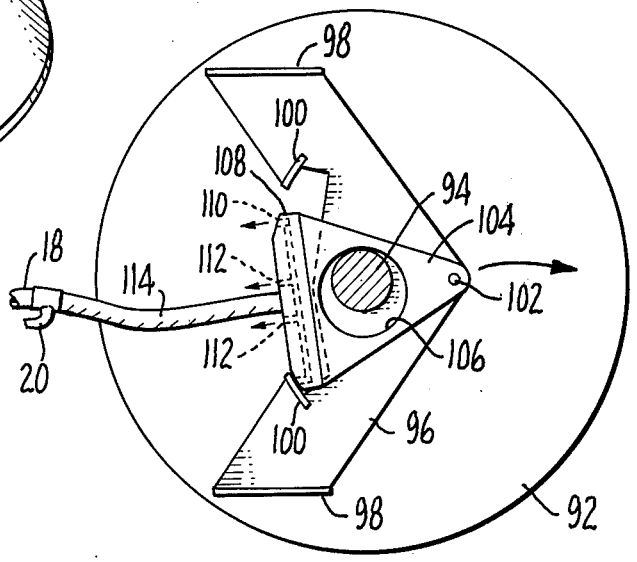
FIG. 12 is a view similar to that of FIG. 11 but showing the cleaner in another condition of operation.
Figure 14:
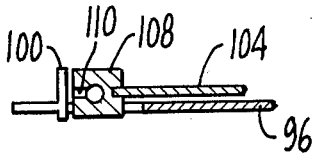
FIG. 14 is a view taken along lines 14—14 of FIG. 11.
Figure 13:
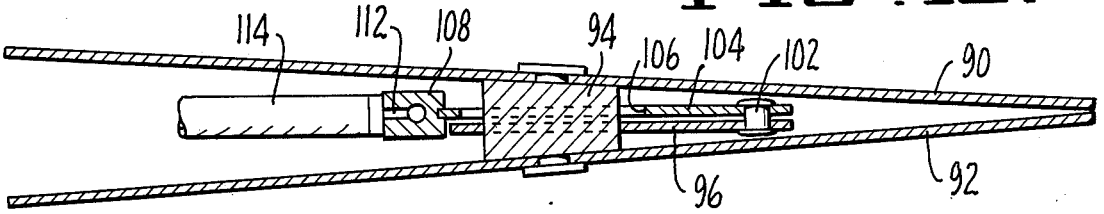
FIG. 13 is a view taken along lines 13—13 of FIG. 11.

FIG. 12 shows the lead section of hose 18 bent which has turned the drive plate 104 about the pin 102 and hidden the lowermost jet opening 110 behind a tab 100. As soon as this happens the jets issuing from the unblocked upper pair of jet openings drive the plate in a clockwise direction (FIG. 12) to unblock the fourth jet and again drive the cleaner straight ahead, as in FIG. 11.

What is claimed is:

1. A swimming pool cleaner comprising a hub member having opposed non-parallel planar faces, a pair of discs, one having its center portion swivel-connected to one of said faces and the other having its center portion swivel-connected to the other of said faces, said planar faces being located substantially within imaginary intersection planes within which said discs are also substantially located.

2. A swimming pool cleaner comprising a hub member having opposed non-parallel planar faces which provide the hub member with axial dimensions of minimum and maximum length spaced substantially 180° apart, a pair of discs, one having its center portion swivel-connected to one of said faces and the other having its center portion swivel-connected to the other of said faces said planar faces being located substantially within imagninary intersecting planes within which said discs are also substantially located, a flexible and bendable water supply hose connected to the hub along the maximum length thereof, first jet drive means comprising a pair of drive jet nozzles carried by the hub and connected to the supply hose and being operable to direct drive jets generally rearwardly along the hose, one at each side thereof, and second jet drive means connected to the hose in spaced relation to said first jet means and upstream therefrom, said second jet means being operable to tow the supply hose portion which is upstream therefrom and, when movement of the discs is impeded, to bend the supply hose portion which is downstream therefrom and thereby re-direct said first jet drive means.

3. A swimmimg pool cleaner comprising a disc, a hub connected to the disc, a flexible and bendable water supply hose radially connected to the hub, a pair of drive jet openings formed in the hub, a collar rotatably carried by the hub, a slot formed in the collar, and rudder means carried by the collar operable to position said slot when said disc is freely moving through the water of a pool to expose both of said jet openings therethrough, drive jet means for the supply hose operable when movement of the disc through the water is slowed down to cause bending of the supply hose and turning of the hub and a consequent hiding of one of said jet openings behind said collar, whereupon the drive jet emitted from the other one of said jet openings reversely turns the hub to again disclose the hidden jet opening through said slot.

4. The cleaner of claim 3, said disc being swivel-connected to one end of said hub, a second disc swivel-connected to the other end of said hub; said hub ends being located in converging planes to cause the perimeters of the discs to be in close proximity at their leading edges.

5. A swimming pool cleaner comprising a hub, a disc swivel-connected to each end of the hub, the hub ends being convergent to bring the discs into close proximity at their leading edges, a flexible and bendable supply hose radially connected to the hub at the trailing side thereof, a plurality of rearwardly directed drive jet nozzles connected to the hub and normally symmetrically disposed with respect to the line of connection of hose to hub, nozzle control means connected to the hub and responsive to a predetermined degree of turning movement of said drive jet nozzles to shut off one nozzle, means responsive to continued operation of the other nozzles to cause reverse turning of said drive jet nozzles to reactivate said shut off nozzle, and means to turn said nozzles comprising a jet drive for the supply hose responsive to a slowing in forward movement of the discs to bend the supply hose portion which is between said jet drive and said hub and thereby turn said nozzles.

6. The cleaner of claim 5, said nozzle control means having associated therewith rudder means responsive to forward movement of the discs to condition said nozzle control means to shut off one nozzle and responsive to cessation of such forward movement to de-condition said nozzle control means to shut off one nozzle.

7. A swimming pool cleaner comprising disc means, hub means attached to the disc means, first jet means attached to the hub means, disposed rearwardly thereof, and being normally operable to move said hub means forwardly, a water supply hose attached to said jet means, second jet means attached upstream to the supply hose tending to axially compress the supply hose portion between said first and second jet means, said portion including a flexible and bendable part, whereby, when the movement of said disc means under the influence of said first jet means is hindered or slowed, said second jet means causes the bending of said hose part to thereby angularly re-orient said first jet means, said first jet means being attached to said hub means through interconnecting ring and web means enabling said first jet means to pull rather than push said hub means.

8. A swimming pool cleaner comprising disc means, hub means attached to the disc means, first jet means attached to the hub means, a water supply hose attached to said jet means, second jet means attached upstream to the supply hose tending to axially compress the supply hose portion between said first and second jet means, said portion including a flexible and bendable part, whereby, when the movement of said disc means under the influence of said first jet means is hindered or slowed, said second jet means causes the bending of said hose part to thereby angularly re-orient said first jet means, said first jet means including at least one jet opening normally disposed at each side of the axis of said hub means, and rudder-controlled jet control means attached to said hub means operable in response to the bending of said hose part to obstruct a jet opening, whereupon said first jet means drives itself in an angular re-orientation movement to tend to remove the bend from said hose and restore a balanced jet flow and ahead movement of said disc means.

9. A swimming pool cleaner comprising disc means, hub means attached to the disc means, first jet means attached to the hub means, a water supply hose attached to said jet means, second jet means attached upstream to the supply hose tending to axially compress the supply hose portion between said first and second jet means, said portion including a flexible and bendable part, whereby, when the movement of said disc means under the influence of said first jet means is hindered or slowed, said second jet means causes the bending of said hose part to thereby angularly re-orient said first jet means, said first jet means being attached to said hub means through interconnecting means enabling said first jet means to pull rather than push said hub means, said first jet means including at least one jet opening normally disposed at each side of the axis of said hub means, and rudder-controlled jet control means attached to said hub means operable in response to the bending of said hose part to obstruct a jet opening, whereupon said first jet means drives itself in an angular re-orientation movement to tend to remove the bend from said hose and restore a balanced jet flow and ahead movement of said disc means.

10. The swimming pool cleaner of claim 8, said hub means having oppositely directed end surfaces which are disposed in converging planes, the line of convergement of said surfaces being substantially parallel to but oppositely directed from the line of direction of said first jet means, said disc means comprising a pair of discs having swivel connections with said end surfaces and having their leading edges in closely disposed relation to each other.

11. The swimming pool cleaner of claim 9, said hub means having oppositely directed end surfaces which are disposed in converging planes, the line of convergement of said surfaces being substantially parallel to but oppositely directed from the line of direction of said first jet means, said disc means comprising a pair of discs having swivel connections with said end surfaces and having their leading edges in closely disposed relation to each other.

* * * * *